United States Patent [19]

Hambric et al.

[11] Patent Number: 5,074,793

[45] Date of Patent: Dec. 24, 1991

[54] MINE EFFECTS SIMULATOR SYSTEM

[75] Inventors: Harry N. Hambric, Prince William County; Wilfred J. Gregson, II, Fairfax County; James D. Lundin, Fairfax County; Kenneth V. Strittmatter, Fairfax County; Lawrence A. Koster, Fairfax, County, all of Va.

[73] Assignee: The United States of America as represented by the Secretary of the Army, Washington, D.C.

[21] Appl. No.: 559,232

[22] Filed: Jul. 30, 1990

[51] Int. Cl.[5] ..... F41A 33/00

[52] U.S. Cl. ..... 434/11; 434/12; 434/16; 434/23

[58] Field of Search ..... 434/15, 23, 11; 102/404, 427

[56] References Cited

U.S. PATENT DOCUMENTS

| | | | |
|---|---|---|---|
| 3,540,136 | 11/1970 | Billingsley | 434/11 |
| 3,847,396 | 11/1974 | Ashford | 434/16 |
| 4,379,401 | 4/1983 | San Miguel | 73/12 |
| 4,744,761 | 5/1988 | Doerfel et al. | 434/16 |
| 4,752,226 | 6/1988 | Akers et al. | 434/11 |

*Primary Examiner*—V. Millin
*Assistant Examiner*—P. Kubel
*Attorney, Agent, or Firm*—Charles D. Miller; Werten F. W. Bellamy; Anthony T. Lane

[57] ABSTRACT

A mine effects simulator system for simulating the operation and encounter of land mines and their potential effects on an armored vehicle. The system utilizes an authentic land mine activation mechanism, radio transmitter and logic circuitry and provides a radio frequency signal when activated by the proximity of an armored vehicle. The armored vehicle has a receiver device which receives the signal to determine a "hit" or "kill" based upon the time of the mine detonation with respect to mine to vehicle position.

13 Claims, 11 Drawing Sheets

MINE EFFECTS SIMULATOR SYSTEM

GOVERNMENT CONTRACT

The present invention was conceived and developed in performance of employment for the Department of the Army of the U.S. Government. All rights in the invention have vested in the U.S. Government.

FIELD OF THE INVENTION

This invention relates to electronic detection devices of the type used to sense the proximity of vehicles and more particularly, to antitank or other type anti-vehicle land mine simulation devices.

DESCRIPTION OF THE PRIOR ART

Proximity detectors have been used for many years and have been built in many designs. Such designs include mechanical trip-detectors, motion detectors, magnetic flux disruption detectors, and microwave detectors.

Generally a comparator or other signal level sensor is used to initiate a signal in response to a predefined "detection parameter". This signal then operates an alarm or a device, such as an electric door opener.

It is important to develop a casualty assessing proximity or other position detector to simulate an anti-vehicle land mine. No such type devices are known today. Such a device would simulate, as closely as possible, the size, structure and operation (reaction without an explosion) of a land mine. An electronic signal is substituted for any explosion.

OBJECTS OF THE INVENTION

An object of the present invention is to provide a land mine simulation system.

A second object of this invention is to provide such a system which includes for simulated land mine detonation and an electronic simulation of the effects of the explosive discharge of a land mine to duplicate the detonation operation of an actual land mine and thereafter electronically react to the simulated detonation.

A further object of this invention is to provide such a system with a casualty assessing subsystem wherein the casualty effects of simulated detonation are electronically assessed.

SUMMARY OF THE INVENTION

The objects of this invention are realized in a casualty assessing, mine effects simulator system.

A ground/land implantation device has a cylinder containing a low power level transmitter which forms a simulation land mine. A tilt rod type fuse and a pressure fuse activating device, a battery, a tilt switch and a logic card are all included in this device.

Logic gates allow the device to activate only one time per arming cycle regardless of the number of encounters.

The mine simulation device transmits one of two electronic signals when activated. A first signal occurs when the tilt rod is activated. This triggers the transmission of a low power signal which is received by a receiver unit in place on a vehicle. This reception triggers logic circuitry within the vehicle receiver unit to activate audio and visual signals. These signals can vary according to the type vehicle upon which the receiver subsystem device is mounted.

The activation of the tilt rod is classified by the system diagnostic and recording devices as a total "kill" of the vehicle. The receiver circuitry will pause and then transmit an alarm signal, to an on board training device processor.

If the pressure fuse in the simulation land mine is activated, it overrides the tilt rod fuse and creates a second signal which indicates a "mobility kill". The total kill (K-kill) and mobility kill (M-kill) provide different programmably predetermined events for training realism. These events can range from energizing the electrical horn system of the vehicle to causing the activation of a smoke grenade. Additionally, the vehicle receiver has the capability of an inter-face with a MILES system (multiple integrated laser engagement system).

The ground/land buried device is relocatable, reusable and programmable to operate as any of a variety of friendly or any antitank mine devices. It simulates live mines and is usable in providing training in mine deployment and mine breaching activities without threat of actual casualties.

DESCRIPTION OF THE DRAWINGS

The features operation and advantages of the present invention will be better understood from a reading of the following invention in which like numerals refer to like elements and in which.

DETAILED DESCRIPTION OF THE INVENTION

Figure 1:
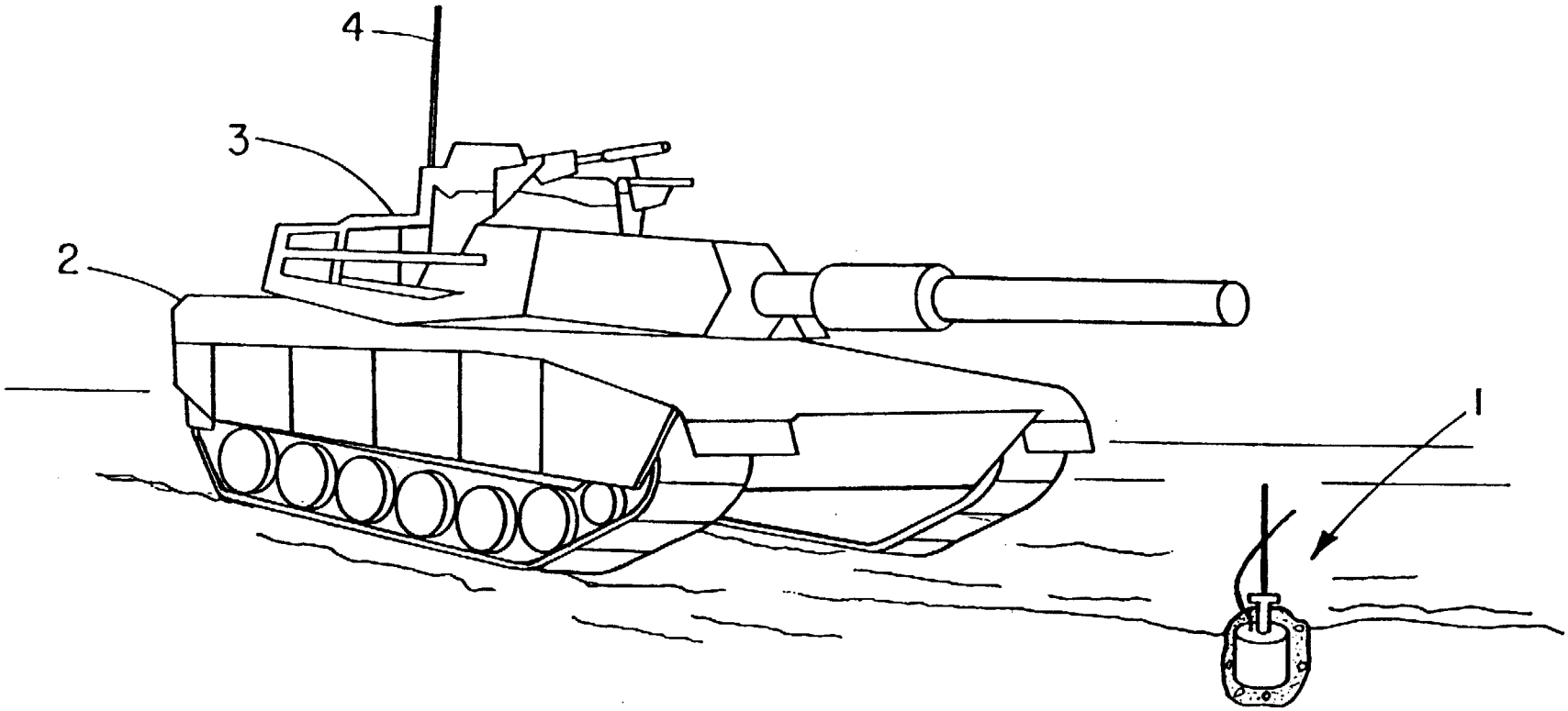
FIG. 1 is a perspective view of an armor-class vehicle approaching a simulation mine of the present invention.

The mine effects simulator system consists of a single type of simulated land mine, FIG. 1. The device is a combination tilt rod and pressure fuse type mine 1. The mine 1 is operative against any type of vehicle including an armor-class vehicle 2, such as the tank shown in FIG. 1.

Such vehicles 2 will include as part of the mine effects simulator system an electronic receiver box 3 located inside the vehicle. The purpose of the mine effects simulator system is to simulate the operation and the effects of the detonation of any of a plurality of land mines, such as that shown in FIG. 1, upon any of a plurality of vehicles, including the tank 2.

The vehicle 2, FIG. 1, with the receiver 3, is set up to receive low power radio frequency signals indicative of a certain type of detonation of a tilt rod/pressure fuse mine 1. It is imperative to note that the tilt rod/pressure fuse mine 1 does not carry an active explosive charge. What it does carry however, is activator circuitry for generating a low power radio frequency signal which indicates the activation of what would normally be a certain type of explosive reaction to the presence of the vehicle 2.

Figure 2:
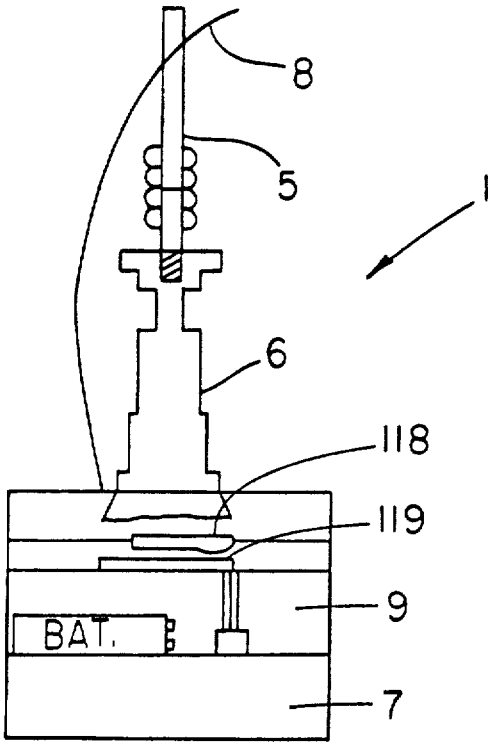
FIG. 2 is a side view cross-section of a tilt rod/pressure switch type simulation mine.

The receiver 3, FIG. 1, includes an antenna 4 for receiving a signal from the tilt rod/pressure fuse type mine 1. In a preferred embodiment this signal is a 49 MHz carrier with either a four or a five pulse code. These two codes distinguish the type of kill which will be further discussed below. The tilt rod/pressure fuse simulation mine 1, FIG. 2, includes a standard type tilt rod activation mechanism 5, a standard type pressure fuse activation mechanism 6 and electronic circuitry components 7. A long whip antenna 8 is connected to the electronic components and is of a sufficient length to be exposed above ground (to transmit a 49 MHz radio frequency signal) when the mine 1 is properly buried.

Figure 2A:
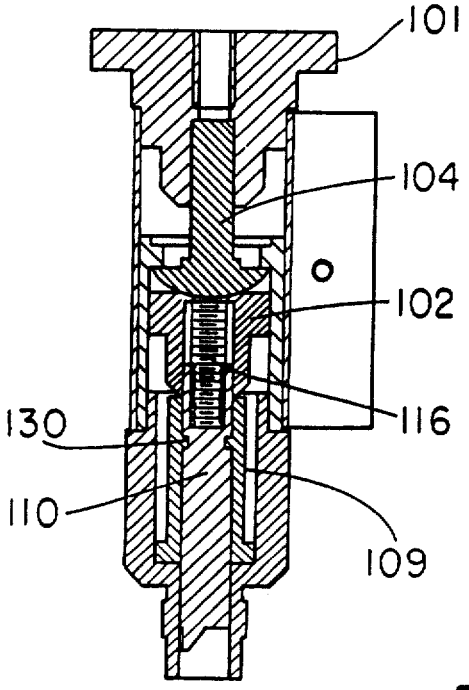
FIG. 2A is a detail of the construction of an illustrative tilt switch.

FIG. 2A shows an illustrative tilt/pressure type switching mechanism. Rod 5 would be rigidly connected to item 101. Tilting rod 5 caused actuator tilt item 104 to move which forces plunger 102 downward. That causes beveled ends of the plunger to force the top ends of sear 109 to move away from firing pin 110. Firing pin 110 was being held in place by those parts item 130 of sear 109. Spring 116 is under compression when pin 110 is in place as shown. Once items 130 are displaced pin 110 is forced downward by the spring. When pin 110 moves down it strikes the switch graphically illustrated by items 118, 119 and causes an electrical output from the switch. This produces a K-kill indication. Another switch within the body of the simulated mine responds to pressure and produces a M-kill indication. It should be recognized that the foregoing is merely an illustrative embodiment of a device which will respond to both a tilt and pressure. Others will be apparent to one of skill in the art.

It is to be understood that the simulation mine 1 does not contain any of the actual components of an operational, live tilt rod/pressure fuse type mine.

This simulation mine 1 of course, is absent the detonator and explosive charge of a normal mine. Where possible mine 1 to make its to add dead weight or ballast to the simulation mine 1 to make its physical characteristics as close as possible to the actual mine which it is intended to simulate.

The electronic circuitry 7 is comprised of logic circuitry and a 49 MHz radio transmitter. The electronic circuitry 7 is connected to a battery 9 and to a long whip antenna 8.

When the mine is activated the transmitter is activated and one of the pulse codes is placed on the 49 MHz frequency carrier depending on whether the tilt rod contact is made or the pressure fuse contact is made.

Figure 3:
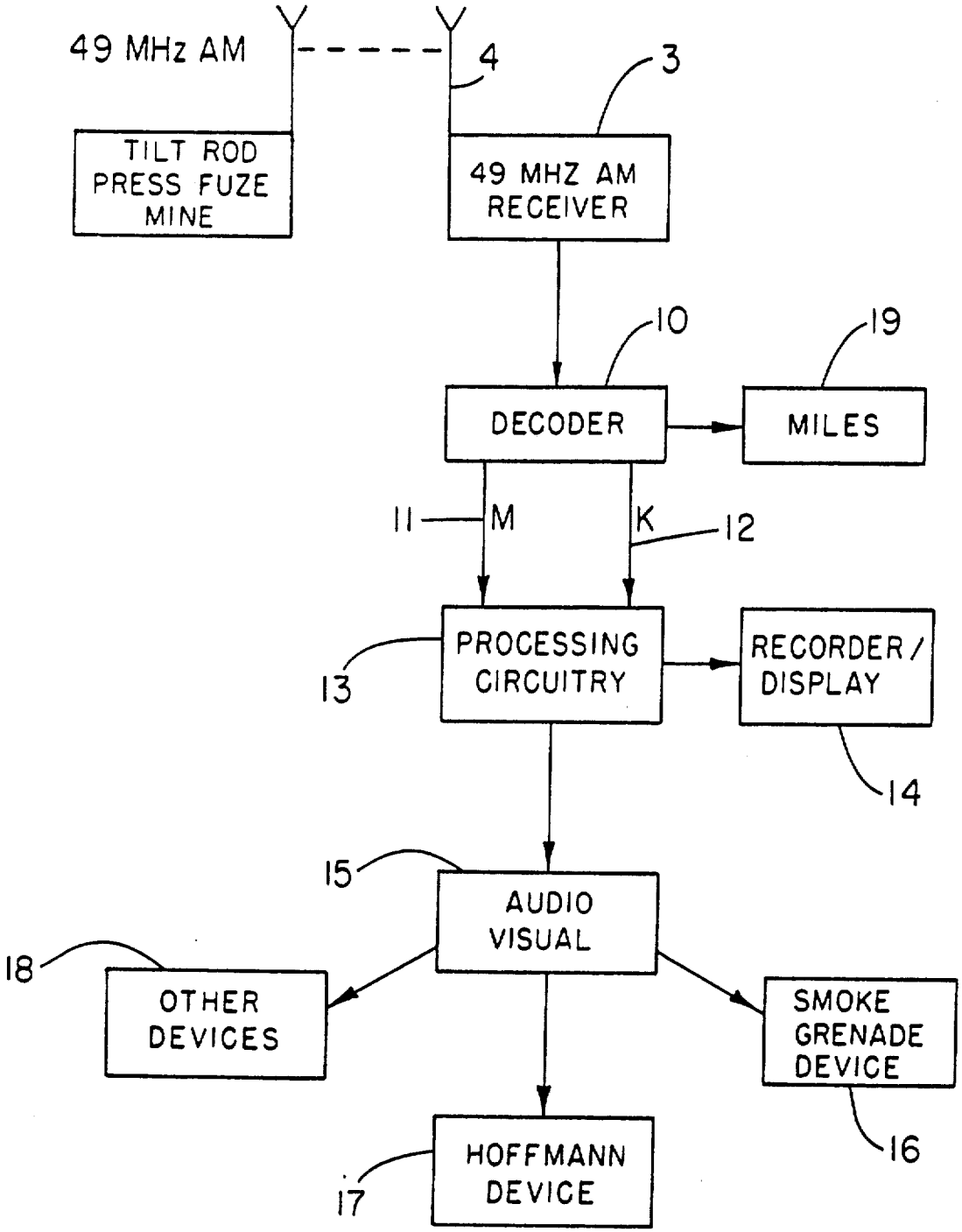
FIG. 3 is a block diagram of the mine effects simulation of the present invention.

FIG. 3 is a block diagram of the system components for the mine effects simulator system of the present invention. This system has the ability to assess vehicle casualties. The simulation tilt rod/pressure fuse mine activated mechanically by the presence of the vehicle either by tilting the tilt rod or depressing the pressure fuse. The receiver 3 output is connected into a decoder circuit 10 which provides two principal functions. The first principal function is to decode the code on the radio frequency signal to determine whether it is a M-kill signal 11 or a K-kill signal 12. Once these signals 11, 12 are decoded they are sent on to processing circuitry 13 which determines and assesses the location of the simulated mine explosion with respect to the vehicle. The processing circuitry may be connected to a recorder/display unit 14 which records the operation of events with respect to movement of the vehicle and simulated mine detonations. This unit 14 may also provide a real-time visual display to the personnel within the vehicle to alert them as to a mine near miss, hit or kill.

In order to simulate the results of a mine detonation, the processing circuitry 13 is further connected to an audio/visual display device control circuitry 15. This audio/visual device control circuitry can be connected to smoke grenade devices 16, Hoffman type (audio/visual alarm devices) 17 and other type of devices 18 as may be selected for the particular type of vehicle. These other type of devices 18 can vary from simple lights to operating the vehicles horn.

The decoder 10 also includes circuitry for interfacing with a MILES system 19. This is a multiple integrated laser engagement system incorporated into many types of vehicles. The MILES itself is not a part of this invention.

Figure 4:
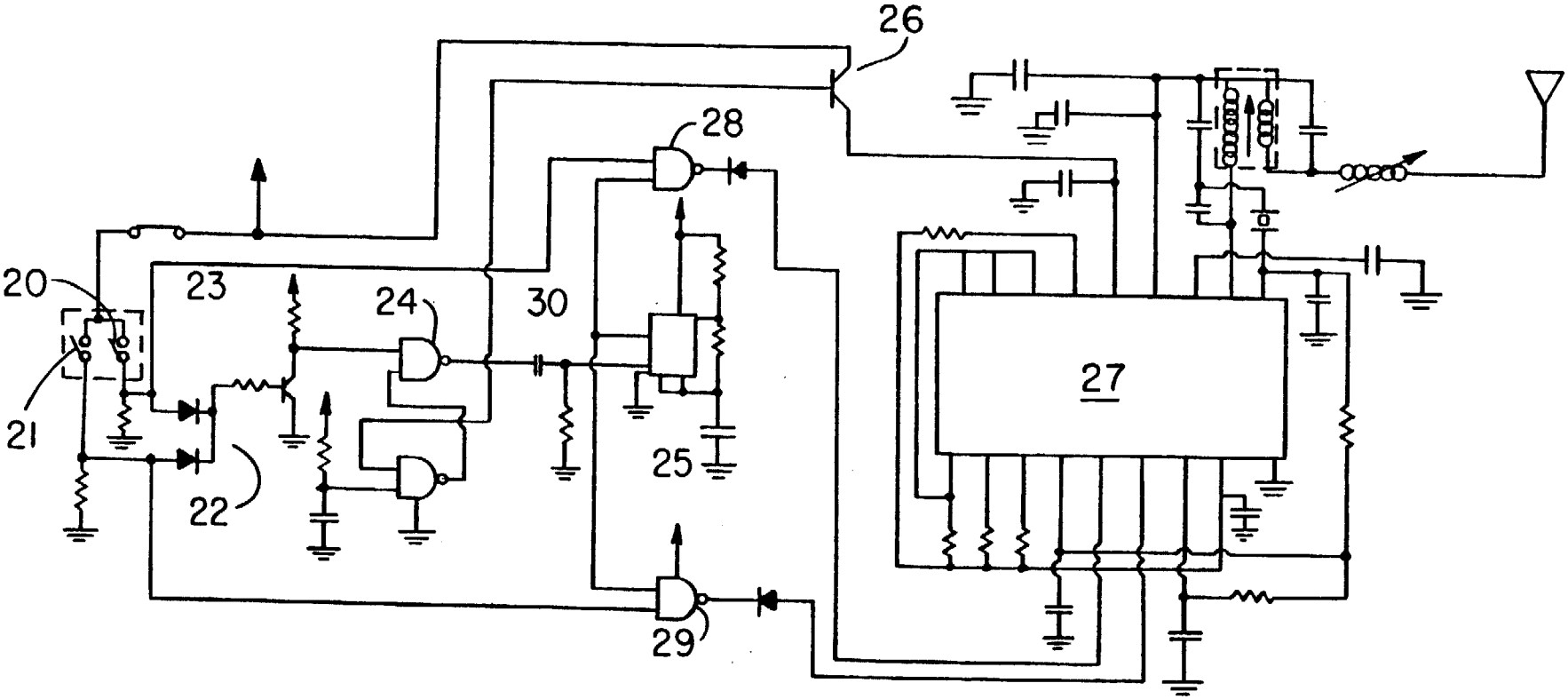
FIG. 4 is a schematic circuit diagram of the mine core transmitter and associated circuitry.

When the mine circuitry, FIG. 4, is activated either by the tilt rod switch 20 or the pressure switch 21 power is supplied through one of the LM4148 diodes 22 to a 2N2222 NPN transistor 23 in an inverting configuration. The 2N2222 NPN transistor 23 causes the flip-flop formed by the two cross-connected NAND gates 24 to lock in at a "high" state. This disables the reset of the 555 timer 25 allowing it to oscillate and also turns on the 2N2222 NPN transistor 26 which supplies power to the transmitter/encoder chip LM1871 27 allowing it to transmit a 49 MHz carrier. The output (pin 3) of the 555 timer 25 is fed into the NAND gates 28 and 29. The other input of NAND gate 28 is tied to the tilt rod switch 20 and if this switch is closed a logical zero is sent to pin 5 of the transmitter/encoder chip LM1871 27 causing a four pulse code to be sent on the 49 MHz carrier. The other input of NAND gate 29 is tied to the pressure switch 21 and if this switch is closed a logical zero appears on pin 6 of transmitter 27 causing a five pulse code to be sent on the carrier.

Figure 6A:
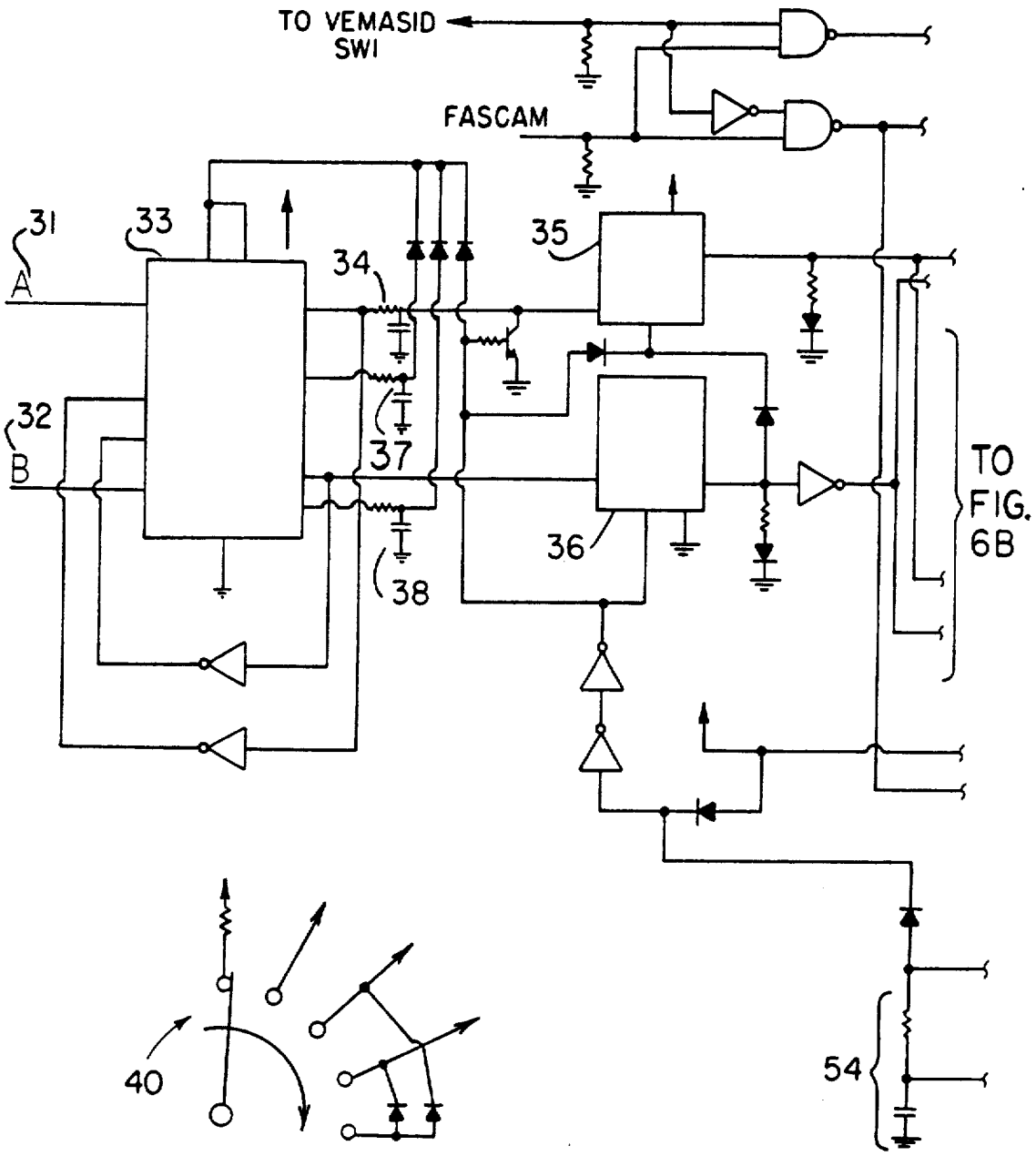
FIGS. 6A, 6B and 6C are a schematic circuit diagram of the decoding/processing/conditioning circuit of the system.
Figure 6B:
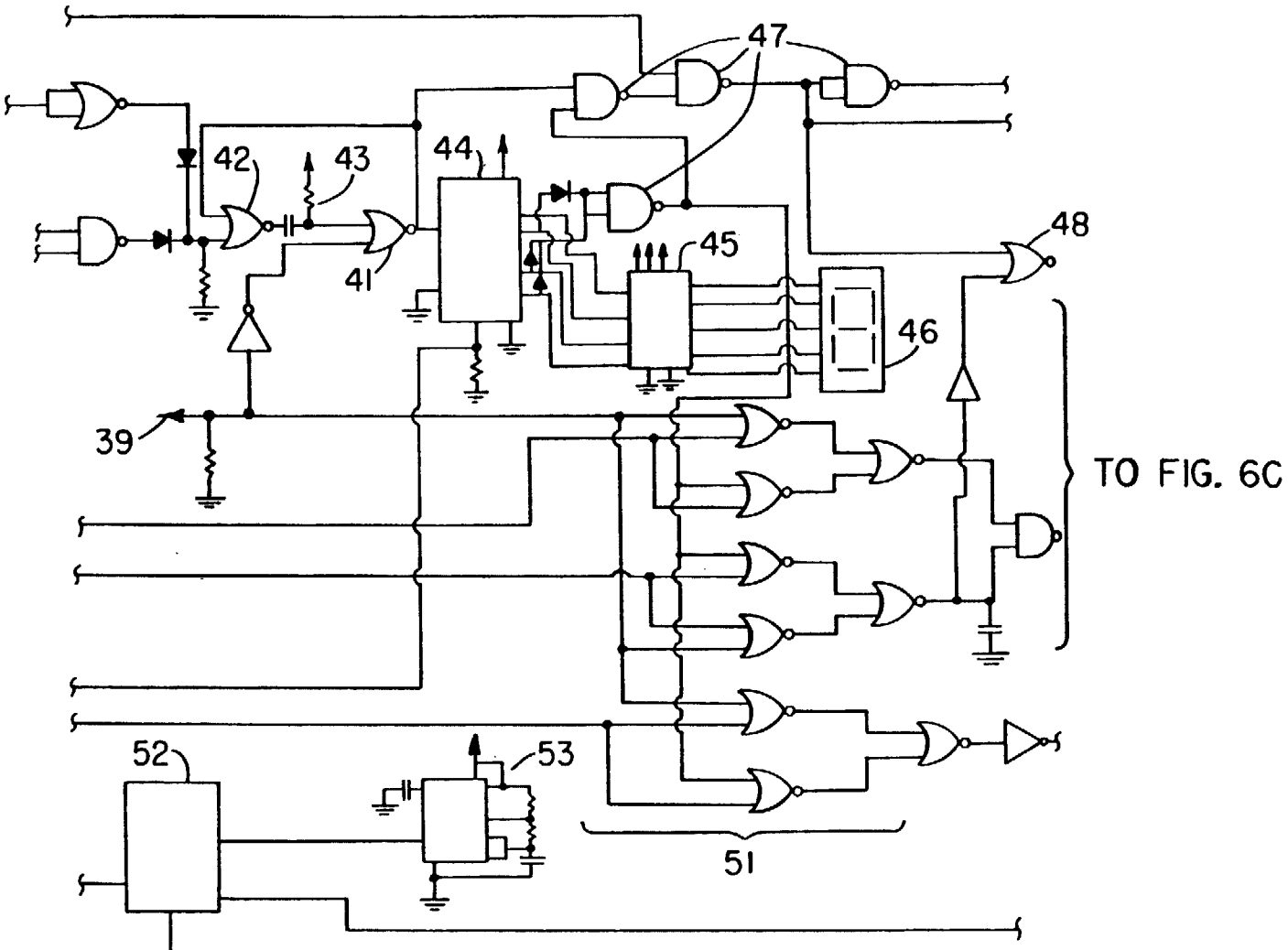
Figure 6C:
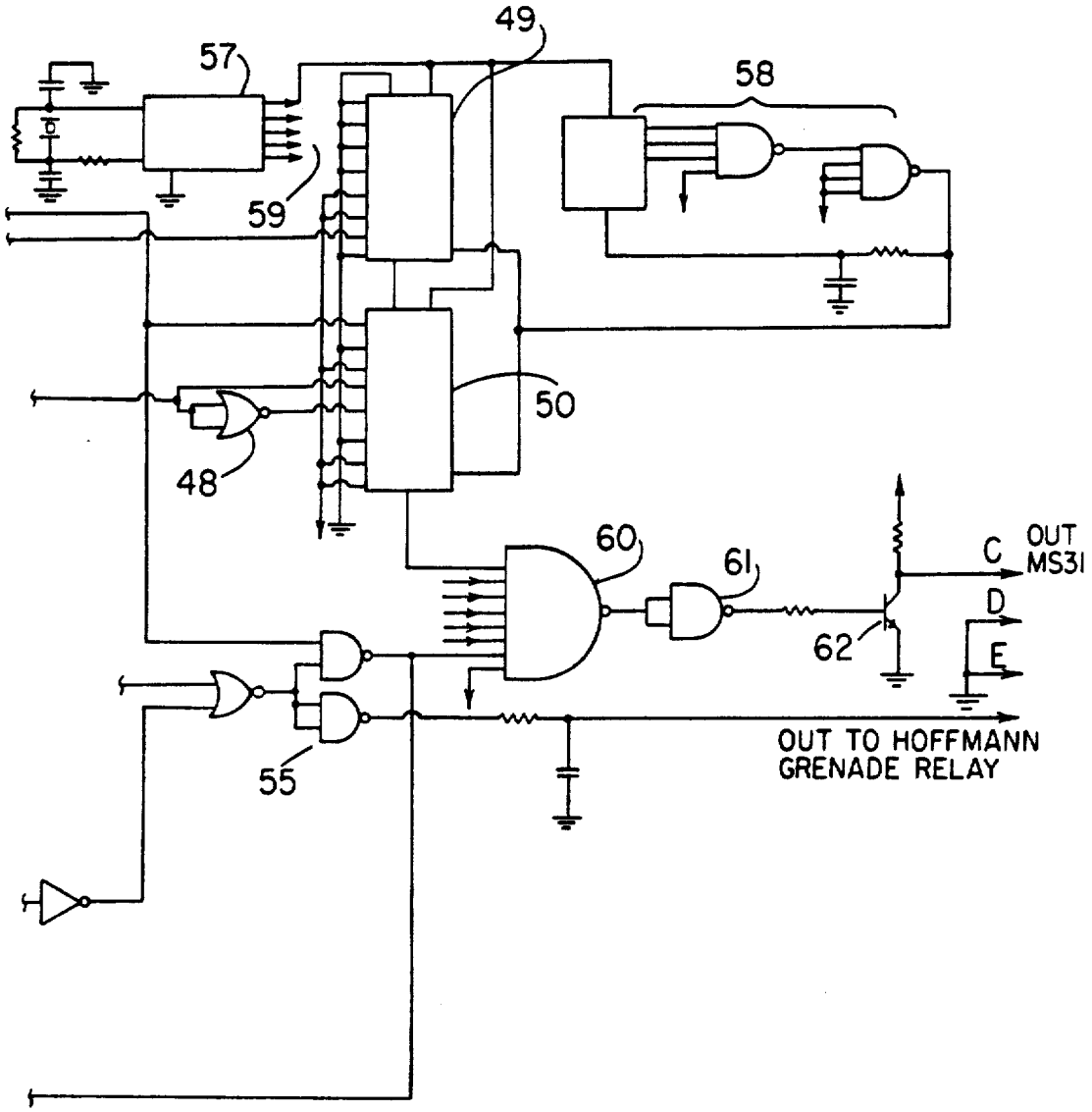

The oscillation of the 555 timer 25 causes the codes being sent by the transmitter to be turned on and off. The circuitry of FIGS. 6A, 6B, 6C (hereinafter FIG. 6) counts the number of times the code is turned on and off and processes that information. The RC network 30 causes the 555 timer 25 to reset when the 15 k resistor discharges the 47 uF capacitor to the reset threshold level thus stopping the on/off switching of the codes.

Figure 5:
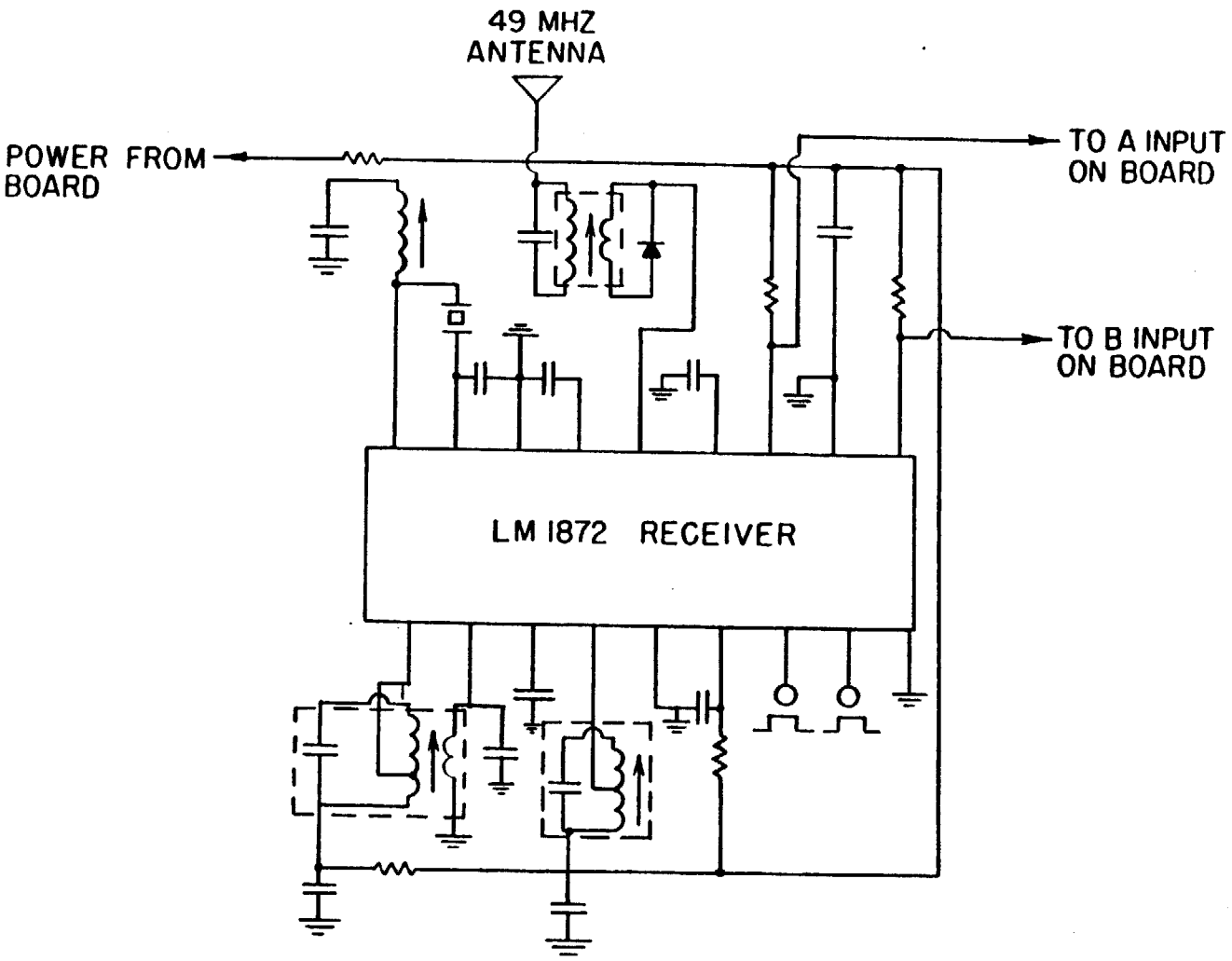
FIG. 5 is a schematic circuit diagram of the receiver and associated circuitry.

The receiver, FIG. 5, is a superheterodyne receiver with digital outputs A and B. The four pulse code is output on channel A 31 and the five pulse code is output on channel B 32. These digital outputs toggle on and off corresponding to the on and off toggling of the transmitter.

The first part of FIG. 6 is the CD4518 Dual Synchronous Up Counter 33, this chip counts the incoming toggles of the A and B channels. If channel A toggles four times indicating a K-kill the RC Network 34 will delay it for approximately one second to see if there is an overriding M-kill on the B channel. If there is no M-kill the K-kill will cause output (pin 2) of the flip-flop 35 to go "low". If there is an M-kill the flip-flop 36 will go "high" on pin 13. When pin 13 goes "high" the counter 33 and the flip-flop 35 are both reset, this gives the M-kill priority. If neither channel A nor B toggles four times the RC networks of 37 and 38 will reset the counter 33 after approximately 2.2 seconds.

The flip-flops 35 and 36 are used to hold the data until the rest of the circuitry can process it. The processing consists of determining if there are breaching devices simulated on the vehicle and sending either an M-kill, a K-kill, or a near-miss code to the MILES equipment. If there are breaching devices a CD4518 Counter 44 and a CD4511 BCD-to-7 Segment Latch/Decoder/Driver 45 increment a 7-Segment display 46 to show the crew how many training mines they have encountered. The first two encounters will produce a near-miss code and the third will cause a K-kill or M-kill code to be sent to the MILES equipment.

The breaching device is simulated by putting power to 39 through the rotary switch 40. When the breaching device is portrayed the NOR gate 41 enables the counter 44 and allows it to increment on the falling edge of the pulse supplied by the one-shot formed by NOR gate 42, RC network 43, and NOR gate 41. If the count is less than three the four NAND gates 47 and the two NOR gates 48 load the near-miss code into the parallel-to-serial shift registers 49 and 50 of FIG. 6. If the count is three, the array of NOR gates 51 determine if the encounter was a K or M-kill and load the appropriate code into the shift registers 49 and 50 via the NOR gates 48.

The MILES signal conditioning portion of the signal processing circuit of FIG. 6 is made up of 49, 50, and 56 through 62. Here an oscillator circuit 56 supplies pulses to a type CD4060 frequency divider 57. The output pin 15 of the CD4060 frequency divider 57 is fed into the serial shift registers 49 and 50 and the jam circuitry 58. The jam circuitry 58 consists of a CD4040 counter and two, 4-input NAND gates. When the CD4040 counter reaches eleven the parallel data is jammed into 49 and 50 and the CD4040 counter of 58 is reset. The outputs 59 of the CD4060 frequency divider 57 are send into the 8-input NAND gate 60, this along with the serial output of shift register 50 creates the proper MILES pulse format. This pulse code is buffered by CD4011 2-input NAND gate 61 and a 2N2222 transistor 62 and is available for input into the MILES system.

The MILES code is sent when the output of NAND gate 51 goes "high" this is done by the same circuitry that loads the MILES codes. When NAND gate 51 goes "high" it also enables the counter 52, which is the other half of counter 44. This counter 52 receives input from the continuously running 555 timer 53 and when it counts four pulses it sends a "high" signal to reset the counter 33 and the flip-flops 35 and 36. It also resets itself after a short delay caused by the RC circuit 54.

Figure 7:
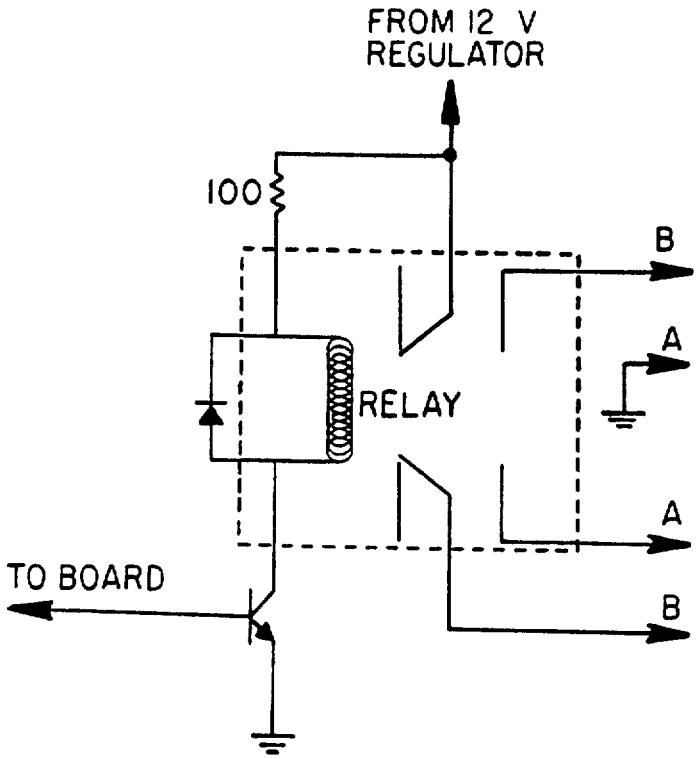
FIG. 7 is a schematic circuit diagram of the relay that activates the smoke grenade and the Hoffman device.

The Hoffman/Smoke Grenade Relay, FIG. 7, is activated by the NAND gate 55, FIG. 6, only when a K or M-kill MILES code is being sent to the MILES computer.

Figure 8:
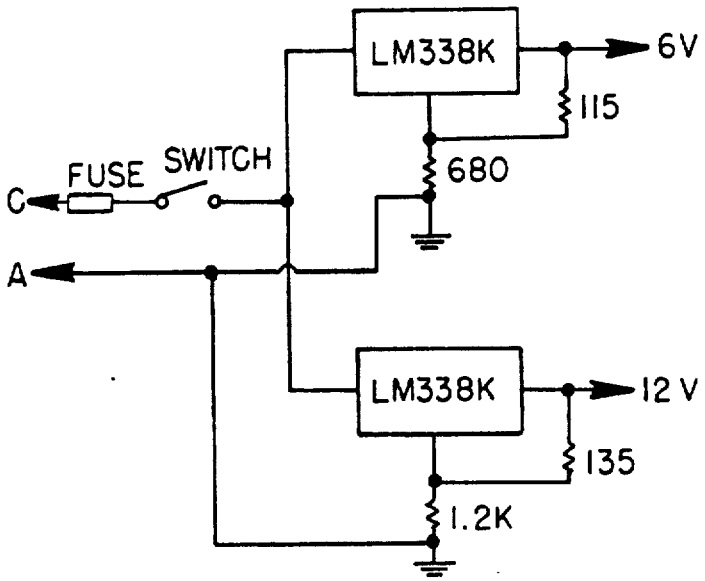
FIG. 8 is a schematic circuit diagram of the voltage regulators used to power the circuitry.

FIG. 8 is a schematic of the two LM338K voltage regulators used to convert vehicle power, typically 24 volts, to 6 volts for the circuitry of FIGS. 5 and 6 and to 12 volts for the relay of FIG. 7.

Figure 9:
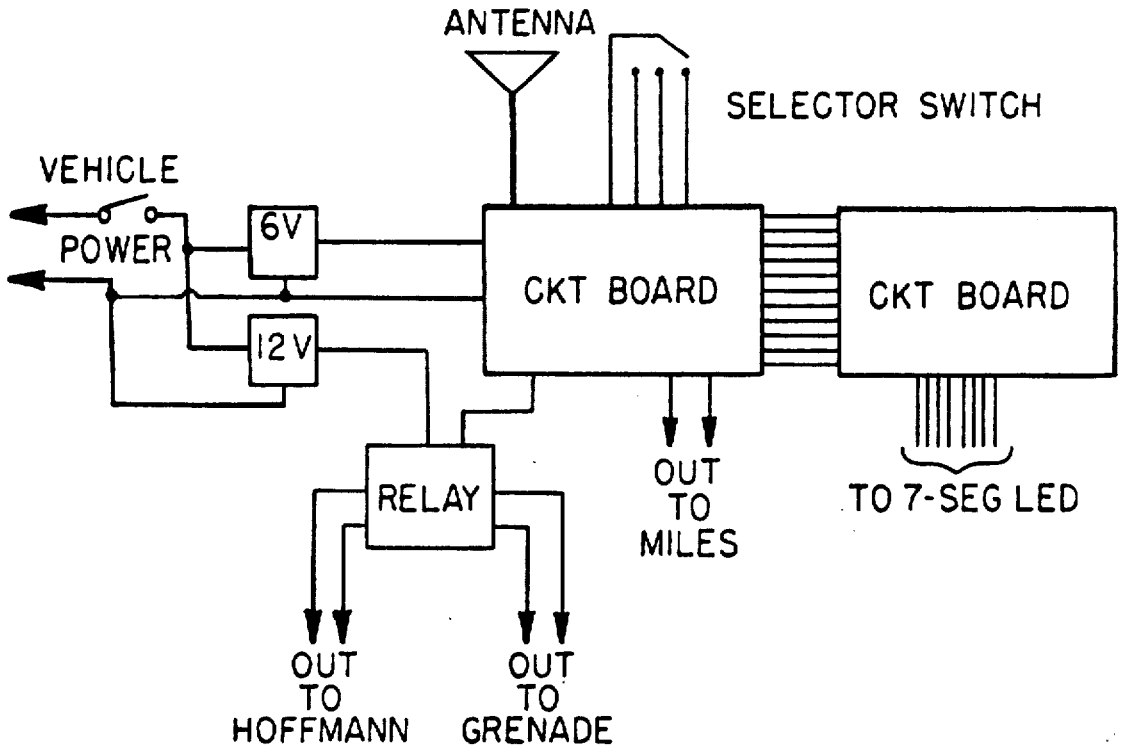
FIG. 9 is a schematic diagram showing how the various circuits fit together.

FIG. 9 shows all of the previously discussed figures as they would fit together to form a complete system.

Figure 10:
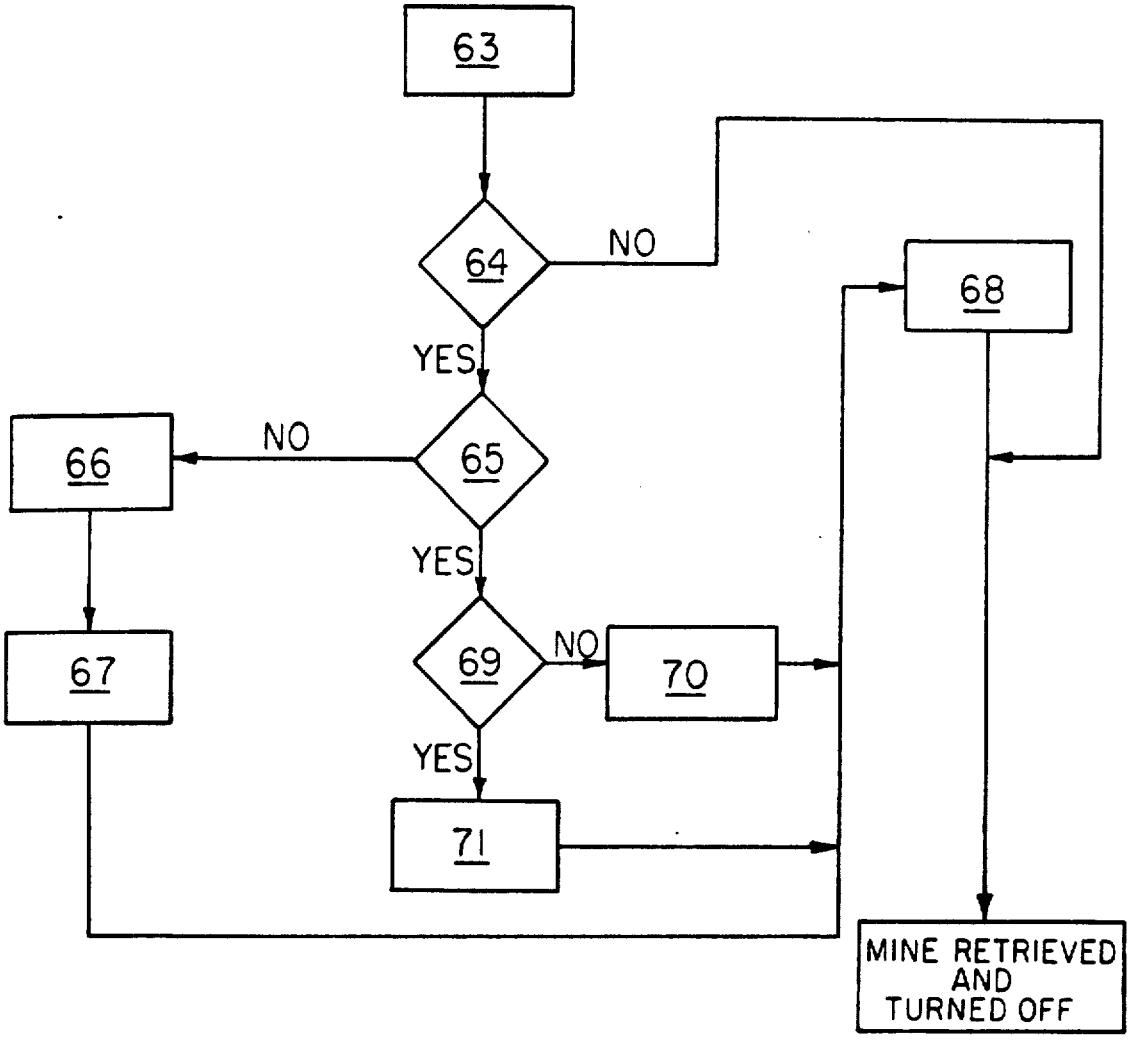
FIG. 10 is a schematic flow chart of the logical operation by which the system is programmed to operate.

FIG. 10 shows a flow chart of the logical operation by which the system is programmed to operate. The first step 63 is to arm the mine after that it is determined whether a mine contact is made or not, step 64. If no mine contact is made then the system remains alert until it is retrieved or the battery goes dead.

However, if a mine contact is made then the system interrogates to determine if it is a tilt rod strike step 65. If there is not tilt rod strike determined in step 65 then interrogation is made to determine if the pressure plate has been hit step 66 and an M-kill signal has been sent step 67. If these steps 66 and 67 have been operated upon the mine then becomes inactive step 68.

If the tilt rod strike interrogation step 65 determines that there has been such a strike the next interrogation is determined whether the pressure plate has been hit step 69. If no pressure plate has been hit than a K-kill signal is sent 70 and the mine goes inactive step 68. If it has been determined in step 69 that the pressure plate has been hit then an M-kill signal is sent step 71 and the mine goes inactive step 68. The anti-tank training mines operate by transmitting a 49 MHz radio frequency (RF) signal when activated. The signal is of sufficiently low power to localize its effective radius to approximately 50 feet. This is sufficient to activate on-vehicle components of vehicles encountering mines, but not those of adjacent vehicles operating in a doctrinally correct formation.

When a mine is encountered, one of two RF codes will be generated: One code for catastrophic kill (K-kill) and another for mobility kill (M-kill). These signals are transmitted to on board vehicle receivers to be further processed.

Each mine is powered by a 9 volt battery, which will be connected when the mine(s) are issued to the receiving unit. Batteries are to be removed when the mines are returned to storage. The item referred to as a mine is actually a "mine core" component. The "mine core" can be used in a stand-alone configuration, and provide training realism (except for the physical characteristics of an actual mine).

To gain total realism, and additional protection for the "mine core", the mine core is meant to be emplaced in a prepared existing metal case mine, or in locally fabricated mines constructed of plastic, wood or concrete. The concrete mine is recommended, because of ease of construction, strength, and cost. When the "mine" is buried in soft ground its outer shell is not as important as when it is emplaced above ground. The strength of concrete provides additional stability and protection to the "mine core". The tilt rod/pressure fuse "mine core" has been designed for total battlefield realism to allow units to train as they will fight. The "mine core" is capable of providing the following training and realism:

a. Inserting the "mine core" into the mine simulates preparing existing mines for arming by inserting the firing chain boosters;

b. Screwing the tilt rod into the fuse, and the fuse assembly onto the "mine core" simulates attaching the fuse. Removing the safety pin and fuse stiffeners from the fuse simulates arming the mine;

c. The tilt rod is inserted into the fuse cap to arm the tilt rod function. The tilt rod/pressure fuse "mine core" can perform both type encounters, or can be configured to perform one or the other . . . allowing total realism in mine fuse selection;

d. A tilt switch in the "mine core" turns the firing circuit off if the mine is tipped over. If the mine is placed upright again it returns to "ready";

e. Training realism is provided by reversing the mine's arming sequence. This allows hand breaching, clearing the battlefield recovery of mines; and f. The mines do not contain anti-handling devices, nor do they assess individual soldier casualties.

The vehicle receiver box assembly consists of a 49 MHz receiver; logic circuits and electronic components to activate a "Hoffman device", standard military smoke grenade or vehicle horn; logic circuits to differentiate between M and K-kill signals; and microprocessing to store, load and transmit appropriate binary codes to the hose vehicle's MILES system.

The vehicle receiver box assembly has built in capability to use all, or some of the functions listed above and may be used with MILES or future generation training system, or in a stand alone configuration. Additionally it can be used in conjunction with vehicles which have mechanical or electronic breaching systems employed. Vehicles with these devices will detonate, but ignore any mines they encounter.

Vehicles with blades, plows, rollers which activate placed (tilt rod/pressure fuse) mines will not be affected by the mine detonation, until the third encounter. At this time it is portrayed that the vehicle breaching device would be sufficiently damaged to allow the vehicle to encounter the mine. Mines encountered (number one through number two) would cause a "near miss/mine" encountered signal to be processed, but not acted on by the kill indicators in the vehicle receiver box, or MILES (if attached). This process does not effect FASCAM (a generic term representing all scatterable mine system) mine encounters unless the vehicle's electromagnetic breaching selection is operating.

Vehicles using the electromagnetic mine breaching selection will ignore FASCAM mine encounters. The near miss/mine encounter designator will function when the mine "detonates", but no damage to the vehicle occurs. This allows the vehicle crew to take action to notify other vehicles of the minefields existence. As long as the electromagnetic breaching selection is activated, the vehicle is protected from FASCAM mines.

Changes can be made in the above-described invention without departing from the intent and scope thereof. The above description is intended to be illustrative of the invention and not limiting.

What is claimed is:

1. A mine effects simulator system, for simulating the operation and encounter of land mines and their potential effects upon an armored vehicle, comprising:

a land mine simulation device having an authentic land mine activation mechanism, radio transmitter and logic circuitry, said land mine simulation device providing a radio frequency signal when activated by the proximity of an armored vehicle; and a receiver device mounted on said armored vehicle for receiving said radio frequency signal from said mine simulation device to determine a "hit" or "kill" said receiver including logic circuitry for determining the type of kill effect on the vehicle as a function of time of mine detonation with respect to mine to vehicle position.

2. The system of claim 1 wherein said mine simulation device logic circuitry determines the type of "kill" detonation of the mine with respect mine to vehicle position at the time of mine detonation said logic circuitry placing a code indicating the type of "kill" detonation on said radio frequency signal provided by said mine simulation device.

3. The system of claim 2 wherein said mine simulation device is a tilt rod/pressure fuse type activation mine simulation device.

4. The system of claim 3 wherein said radio frequency signal provided by said tilt rod/pressure fuse type activation mine simulation device is of low power having a short range.

5. The system of claim 4 wherein said tilt rod activation causes said mine simulation device logic circuitry to place a first code on said low power radio frequency signal.

6. The system of claim 5 wherein said pressure fuse activation causes said mine simulation device logic circuitry to place a second code on said low power radio frequency signal.

7. The system of claim 6 wherein said low power radio frequency signal is amplitude modulated (AM); wherein said first code is a four pulse code modulating said AM radio frequency signal; and wherein said second code is a five pulse code modulating said AM radio frequency signal.

8. The system of claim 7 wherein said receiver device includes:

an antenna;

an AM radio receiver circuit connected to said antenna;

a decoder circuit connected to said AM radio receiver circuit;

processing circuitry connected to said decoder circuit; and at least one display device connected to said processing circuitry.

9. The system of claim 8 wherein said processing circuitry has a plurality of display devices connected thereto, said processing circuitry being operative to selectively operate said plural display devices.

10. The system of claim 9 wherein said display devices include:

a smoke grenade activation circuitry device connected to said processing circuitry and operative therefrom;

audio signal circuitry connected to said processing circuitry and operative therefrom; and a recorder/display circuit connected to said processing circuitry and operative therefrom.

11. The system of claim 10 wherein the processing circuitry operates to search for the simultaneous and near simultaneous occurrence of the detection of said first code and said second code and to inhibit processing in response to said first code in the presence of said second code.

12. The system of claim 11 wherein said mine simulation device logic circuitry deactivates said mine simulation device once a said tone carrying radio frequency signal is transmitted.

13. The system of claim 12 wherein said mine simulation device can be recovered, reset and reused.

* * * * *